US009284814B2

(12) United States Patent
Slup et al.

(10) Patent No.: US 9,284,814 B2
(45) Date of Patent: Mar. 15, 2016

(54) DOWNHOLE TOOL WITH REMOTELY ACTUATED DRAG BLOCKS AND METHODS

(71) Applicant: Baker Hughes Incorporated, Houston, TX (US)

(72) Inventors: Gabriel Antoniu Slup, Spring, TX (US); Douglas Julius Lehr, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 386 days.

(21) Appl. No.: 13/778,373

(22) Filed: Feb. 27, 2013

(65) Prior Publication Data

US 2014/0238697 A1 Aug. 28, 2014

(51) Int. Cl.

| | |
|---|---|
| ***E21B 23/01*** | (2006.01) |
| ***E21B 23/06*** | (2006.01) |
| ***E21B 33/129*** | (2006.01) |
| *E21B 34/00* | (2006.01) |

(52) U.S. Cl.
CPC ..... *E21B 33/1291* (2013.01); *E21B 2034/005* (2013.01)

(58) Field of Classification Search
CPC ..... E21B 23/01; E21B 23/06; E21B 33/128; E21B 33/129; E21B 33/12955
See application file for complete search history.

(56) References Cited

U.S. PATENT DOCUMENTS

| | | | | |
|---|---|---|---|---|
| 3,054,451 | A * | 9/1962 | Bonner | 166/123 |
| 7,854,268 | B2 | 12/2010 | Lehr et al. | |
| 8,141,627 | B2 | 3/2012 | Krieg et al. | |
| 2011/0214873 | A1 | 9/2011 | Krieg et al. | |

* cited by examiner

*Primary Examiner* — Cathleen Hutchins
(74) *Attorney, Agent, or Firm* — E. Randall Smith; Jones & Smith, LLP

(57) ABSTRACT

Apparatus useful for remotely actuating the drag blocks of a downhole tool includes at least one remotely actuated sleeve configured to allow the drag blocks to move from one position to another when the downhole tool is disposed in a well bore.

37 Claims, 13 Drawing Sheets

DOWNHOLE TOOL WITH REMOTELY ACTUATED DRAG BLOCKS AND METHODS

FIELD OF THE DISCLOSURE

The present disclosure relates generally to downhole tool technology and, more particularly, apparatus and methods for actuating drag blocks on a downhole tool.

BACKGROUND

In the hydrocarbon exploration and production industries, downhole tools are often equipped with spring-biased "drag blocks" that extend radially outwardly from the tool to frictionally grip the casing or other area in the underground well. For example, downhole packers typically include drag blocks that will grip the casing as part of the control mechanism that allows movement of the packing elements to an operating or engaged position. The drag-block equipped tools are often configured with the drag blocks in their radially extended position. In many scenarios, such as, for example, when the tool is deployed in a subsea well, it may be advantageous to deploy and/or retrieve the tool with the drag blocks in a retracted position and selectively remotely move the drag blocks to and/or from an extended position when desired.

It should be understood that the above-described discussion is provided for illustrative purposes only and is not intended to limit the scope or subject matter of the appended claims or those of any related patent application or patent. Thus, none of the appended claims or claims of any related application or patent should be limited by the above discussion or construed to address, include or exclude each or any of the above-cited features merely because of the mention thereof herein.

Accordingly, there exists a need for improved systems, apparatus and methods useful in connection with downhole tools equipped with drag blocks having one or more of the attributes or capabilities described or shown in, or as may be apparent from, the other portions of this patent.

BRIEF SUMMARY OF THE DISCLOSURE

In some embodiments, the present disclosure involves a packer assembly for use in an oil and gas well having a well bore. The packer assembly includes a tubular mandrel having an upper end and a lower end, the upper end being disposed up-hole of the lower end in the well bore when the packer assembly is disposed therein. A central bore of the packer assembly extends at least through the mandrel from the upper end to the lower end thereof. A plurality of drag blocks is associated with the mandrel. Each drag block is mounted within a drag block housing and configured to be movable radially outwardly therefrom and relative to the mandrel from a retracted position to an extended position. In its retracted position, each drag block is disposed proximate to its drag block housing and spaced away from the well bore wall when the packer assembly is disposed therein. Each drag block in the extended position is disposed radially outwardly of its drag block housing and engageable with the well bore wall when the packer assembly is disposed therein. The drag blocks are held in the retracted position when the packer assembly is inserted into the well bore.

In these embodiments, at least one selectively-actuated retention sleeve is disposed between the mandrel and the drag blocks. At least one retainer connects each drag block (in the retracted position) to the retention sleeve. The retainers are configured to disconnect from at least one among its associated drag block and the retention sleeve, allowing the drag block to move from its retracted position to its extended position upon actuation of the retention sleeve when the packer assembly is positioned at a desired location in the well bore.

In many embodiments, the present disclosure involves a packer assembly for use in an oil and gas well having a well bore. The packer assembly includes a tubular mandrel having an upper end and a lower end. A central bore of the packer assembly extends at least through the mandrel from the upper end to the lower end thereof. A plurality of drag blocks is associated with the mandrel. Each drag block is mounted within a drag block housing and configured to be movable radially inwardly relative to its housing and the mandrel from an extended position to a retracted position. Each drag block in its extended position is disposed radially outwardly of its drag block housing and engageable with the well bore wall when the packer assembly is disposed therein. Each drag block in its retracted position is disposed proximate to its drag block housing and spaced away from the well bore wall when the packer assembly is disposed therein.

In these embodiments, at least one retraction sleeve is disposed over the drag blocks and axially movable relative thereto from an open position to a closed position. The retraction sleeve includes a plurality of windows formed therein and, in the open position, allows the drag blocks in the extended position to extend through the windows. In the closed position, the retraction sleeve holds the drag blocks into the retracted position. As the retraction sleeve moves from the open to the closed positions, it will bias the drag blocks from their extended position into their retracted position when the packer assembly is disposed within the well bore.

In various embodiments, the present disclosure involves a downhole tool for use in an oil and gas well having a well bore. The downhole tool includes a tubular mandrel having an upper end and a lower end. A central bore extends at least through the mandrel from the upper end to the lower end thereof. A plurality of drag blocks is associated with the mandrel, each drag block being mounted within a corresponding drag block housing. Each drag block is configured to be movable radially outwardly relative to its housing and the mandrel from a retracted position to an extended position. In the retracted position, each drag block is disposed proximate to its drag block housing and spaced away from the well bore wall when the tool is disposed therein. In the extended position, each drag block is disposed radially outwardly of its drag block housing and engageable with the well bore wall when the tool is disposed therein. The drag blocks are held in the refracted position when the tool is inserted into the well bore.

In these embodiments, a selectively-actuated retention sleeve is disposed between the mandrel and the drag blocks, and a retainer connects each drag block in its retracted position to the retention sleeve. The retainers are configured to disconnect from at least one among their associated drag block and the retention sleeve, allowing the drag block to move from its retracted to its extended position upon actuation of the retention sleeve when the tool is positioned at a desired location in the well bore. A retraction sleeve is engageable over the drag blocks and selectively axially movable relative thereto from an open position to a closed position. The retraction sleeve includes a plurality of windows formed therein, and in the open position, allows the drag blocks in the extended position to extend through the windows. In the closed position, the retention sleeve is configured to retain the drag blocks in the retracted position.

In some embodiments, the present disclosure involves a method of remotely actuating the drag blocks of a downhole tool in the well bore of an oil and gas well. The downhole tool includes a central bore. Each drag block is mounted in a drag block housing and spring-biased radially outwardly by at least one biasing member. The method includes at least one retainer connecting each drag block to at least one selectively axially movable retention sleeve. Each retainer holds its associated drag block in a retracted position proximate to its associated drag block housing and spaced away from the well bore wall when the downhole tool is disposed therein. The downhole tool is deployed to a desired location in the well bore. The retention sleeve in moved axially relative to the drag blocks and disengages each retainer from its associated drag block and/or the retention sleeve. The biasing member(s) associated with each drag block expand radially outwardly and bias the drag block into an extended position in contact with the well bore wall.

In many embodiments, the present disclosure involves a method of remotely actuating the drag blocks of a downhole tool in the well bore of an oil and gas well. The downhole tool includes a central bore. Each drag block is mounted in a respective drag block housing and spring-biased radially outwardly by at least one biasing member. The method includes providing at least one selectively axially movable retraction sleeve on the downhole tool over the drag blocks. The retraction sleeve includes a plurality of windows through which the drag blocks extend and engage the well bore wall. When it is desired to disengage the drag blocks from the well bore wall, the refraction sleeve is selectively moved axially relative to the drag blocks. The retraction sleeve urges the drag blocks radially inwardly into a retracted position, compressing the biasing members associated therewith. The refraction sleeve thereafter holds the drag blocks in the retracted position.

Accordingly, the present disclosure includes features and advantages which are believed to enable it to advance downhole tool technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
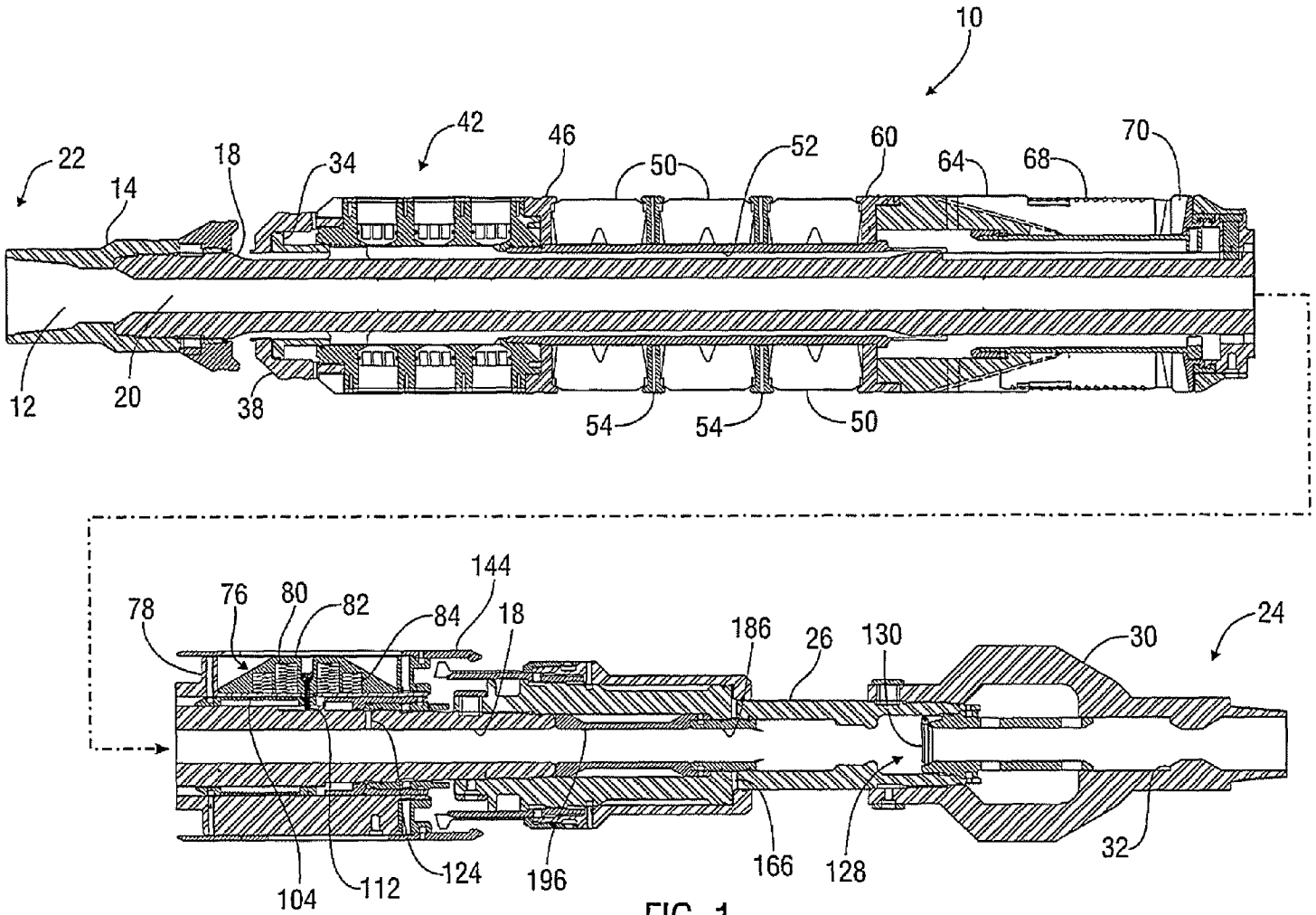
FIG. 1 is a cross-sectional view of an exemplary packer assembly having remotely actuated drag blocks in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIG. 1, the illustrated downhole tool is a packer assembly 10 for use in an oil and gas well (not shown). For example, the packer assembly 10 may be a retrievable service packer. The exemplary packer assembly 10 includes a top sub 14, a base pipe or mandrel 18, a bottom sub 26 and a lower guide 30. A central bore 12 extends through all of these components. The mandrel 18 has a bore 20 and carries various known components, including a booster piston 34, booster piston housing 38, button assembly 42, upper gage ring 46, packing elements 50, packing element support sleeve 52, packing element spacers 54, lower gage ring 60, cones 64, slips 68, slip rings 70 and multiple drag blocks 76.

Each exemplary drag block 76 is disposed in a drag block housing 78 and includes one or more biasing member 80, such as a spring, compressed in pockets 84 formed in the drag block 76. The illustrated biasing members 80 are configured to bias the associated drag block 76 radially outwardly relative to the mandrel 18 and into engagement with the well bore wall 90 (FIG. 3) when the assembly 10 is disposed in the well bore 88 of the well. In this example, the drag blocks 76 are useful to provide a frictional grip against the casing 92 (e.g. FIG. 3) in the well bore 88 as part of the control mechanism that allows movement of the packing elements 50 into an operating or engaged position. However, the present disclosure is not limited to this exemplary use of the drag blocks 76. The drag blocks 76 may be used for any suitable or desirable purpose. Accordingly, the use of the drag blocks 76 is not limiting upon the present disclosure.

The aforementioned components of the packer assembly 10 and further details of their form, configuration and operation are known in the art. Moreover, the present disclosure is not limited to use with the exemplary packer assembly 10, and may be used with any other type of packer assembly 10 having some or all of the same or similar components as described above, or having different components. Further, it should be understood that all the various features of the present disclosure as described below and shown in the appended drawings are not limited to use with packer assemblies, but can be used with any other type of downhole tool, such as, for example, mechanical setting tools used with cement retainers (not shown).

Figure 2:
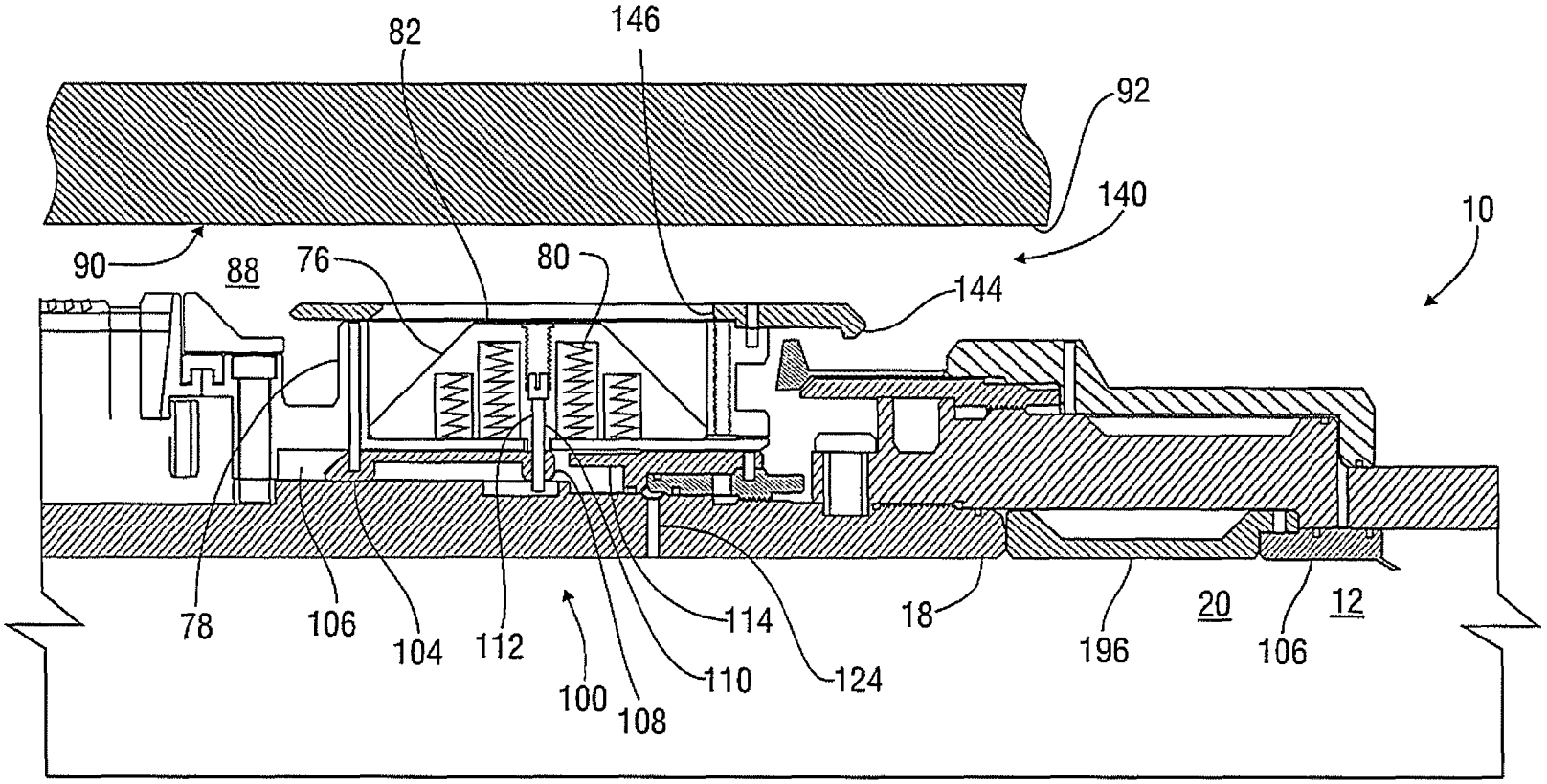
FIG. 2 is a partial cross-sectional view of some components associated with the remotely actuated drag blocks of the packer assembly of FIG. 1 and showing the exemplary drag block in a retracted position in a well bore.
Figure 3:
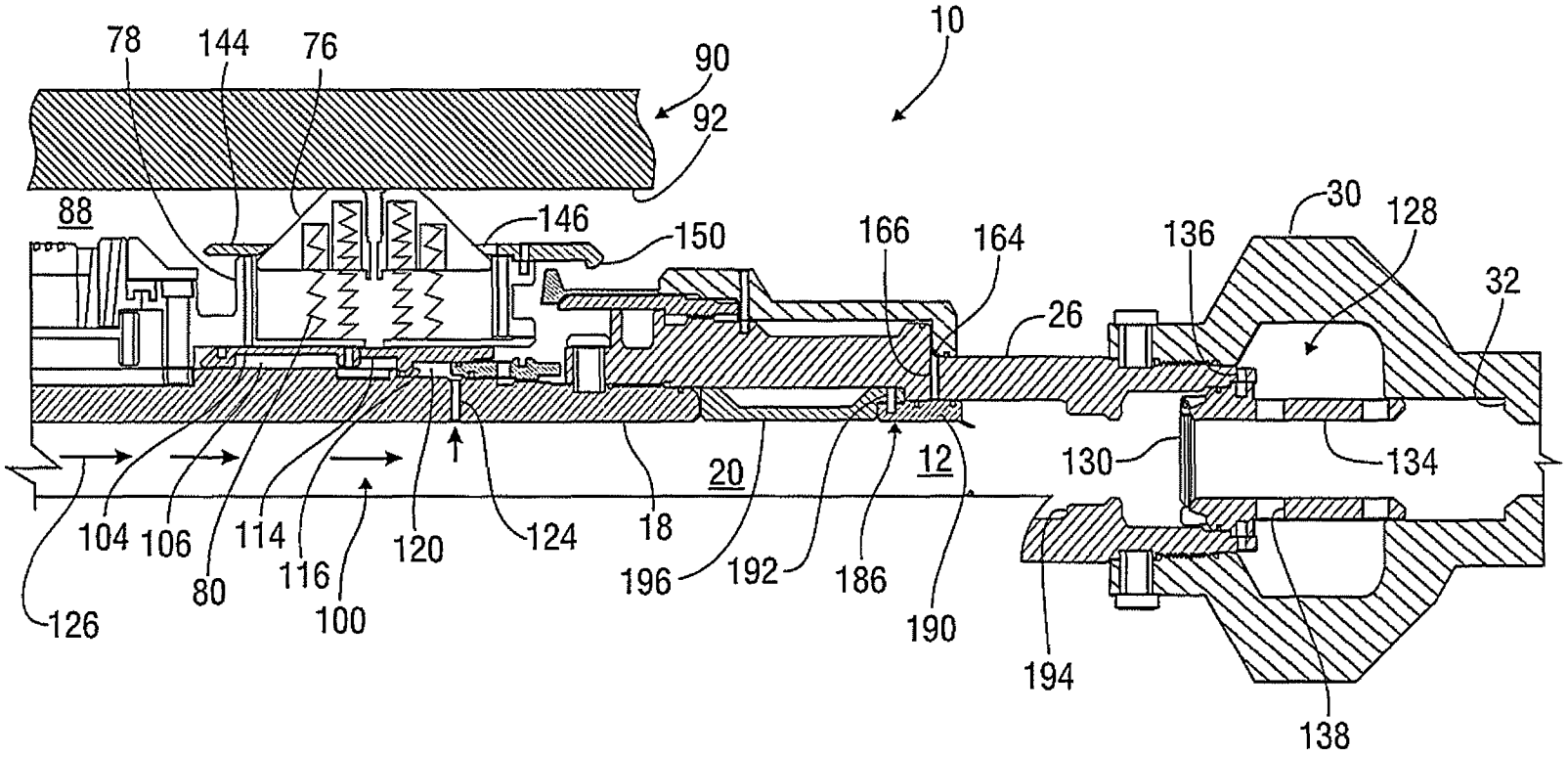
FIG. 3 is a partial cross-sectional view of some components associated with the remotely actuated drag blocks of the packer assembly of FIG. 1 showing the exemplary drag block in an extended position in a well bore.

Now referring to FIG. 2, in accordance with one aspect of the present disclosure, each drag block 76 of this embodiment is selectively movable radially outwardly relative its housing 78 and the mandrel 18 from a retracted position to an extended position (FIG. 3). In the refracted position, the exemplary biasing members 80 are compressed and the drag blocks 76 are held generally within, or closely proximate to, their respective drag block housings 78. As shown, the drag blocks 76 in the retracted position are spaced away from the well bore wall 90, such as a casing 92, when the assembly 10 is disposed within the well bore 88. This position of the drag blocks 76 may be useful for any desired purpose, such as, for example, during deployment of the packer assembly 10 to and/or from one or more locations of the packer assembly 10 (or other tool) in the well bore 88 without the drag blocks 76 becoming hung up or damaging any equipment or components along the way. In the extended position, as shown in FIG. 3, the illustrated drag blocks 76 are disposed radially outwardly of their associated drag block housings 78 to the full extension of the biasing members 80 and/or until the drag blocks 76 engage the well bore wall 90.

Referring back to FIG. 2, in this embodiment, a drag block retention system 100 is provided to hold the drag blocks 76 in the retracted position until they are moved into the extended position. The drag block retention system 100 may have any suitable form, configuration and operation. The illustrated system 100 includes at least one retention sleeve 104 disposed between the mandrel 18 and the drag blocks 76, and at least one the releasable retainer 110 engaged between the retention sleeve 104 and each drag block 76 in a retracted position. Each exemplary retainer 110 is releasable from the retention sleeve 104 and/or its associated drag block 76 to allow the drag block 76 to move from its retracted position to its extended position, such as when the packer assembly 10 is positioned at a desired depth or location in the well bore 88.

Still referring to FIG. 2, the retention sleeve 104 and retainers 110 may have any suitable form, configuration and operation. For example, the retainer 110 may be a releasable connector 112 that is releasable upon sufficient movement of the retention sleeve 104. The releasable connectors 112 may have any suitable form and configuration, such as shear pins, shear screws or other frangible members. In this embodiment, the releasable connector 112 is a shear screw extending through the drag block 76 and secured to the retention sleeve 104. The exemplary retention sleeve 104 is selectively movable axially relative to the mandrel 18 in the "up-hole" direction (towards the upper, or proximal, end 22 of the packer assembly 10 (FIG. 1)) within an annular space 106 between an "engaged" position and a "disengaged" position. In the engaged position, as shown, the illustrated retention sleeve 104 is connected to the drag blocks 76 via the releasable connectors 112.

Referring now to FIG. 3, upon sufficient axial movement, the exemplary retention sleeve 104 will move into its disengaged position, releasing or breaking the retainers 110 and disengaging the sleeve 104 from the drag blocks 76. The retention sleeve 104 may be axially movable in any suitable manner. For example, a retention piston 114 may be slideable within the annular space 106 down-hole, or distal, of the retention sleeve 104. The exemplary retention piston 114 is pressure-activated to push the retention sleeve 104 from its engaged position to its disengaged position. In this embodiment, the retention piston 114 is selectively driven in the up-hole direction upon fluid pressurization of a pressure chamber 120 acting on one or more piston face 116 of the piston 114.

Still referring to FIG. 3, the pressure chamber 120 may be pressurized in any suitable manner. In this example, at least one port 124 fluidly communicates with the pressure chamber 120 and central bore 12. The illustrated bore 12, port 124 and pressure chamber 120 are pressurized with fluid (arrows 126) after the lower end of the bore 12 of the packer assembly 10 is sufficiently blocked. For example, the packer assembly 10 may be equipped with a flapper valve member 130 extendable in a seated, or closed, position across the bore 12 when the assembly 10 is stationary in the well bore 88. Thus, when the illustrated flapper valve member 130 is seated or closed, the bore 12 above the valve member 130, port 124 and pressure chamber 120 may be selectively pressurized (e.g. from the surface) to actuate the retention sleeve 104.

Figure 12:
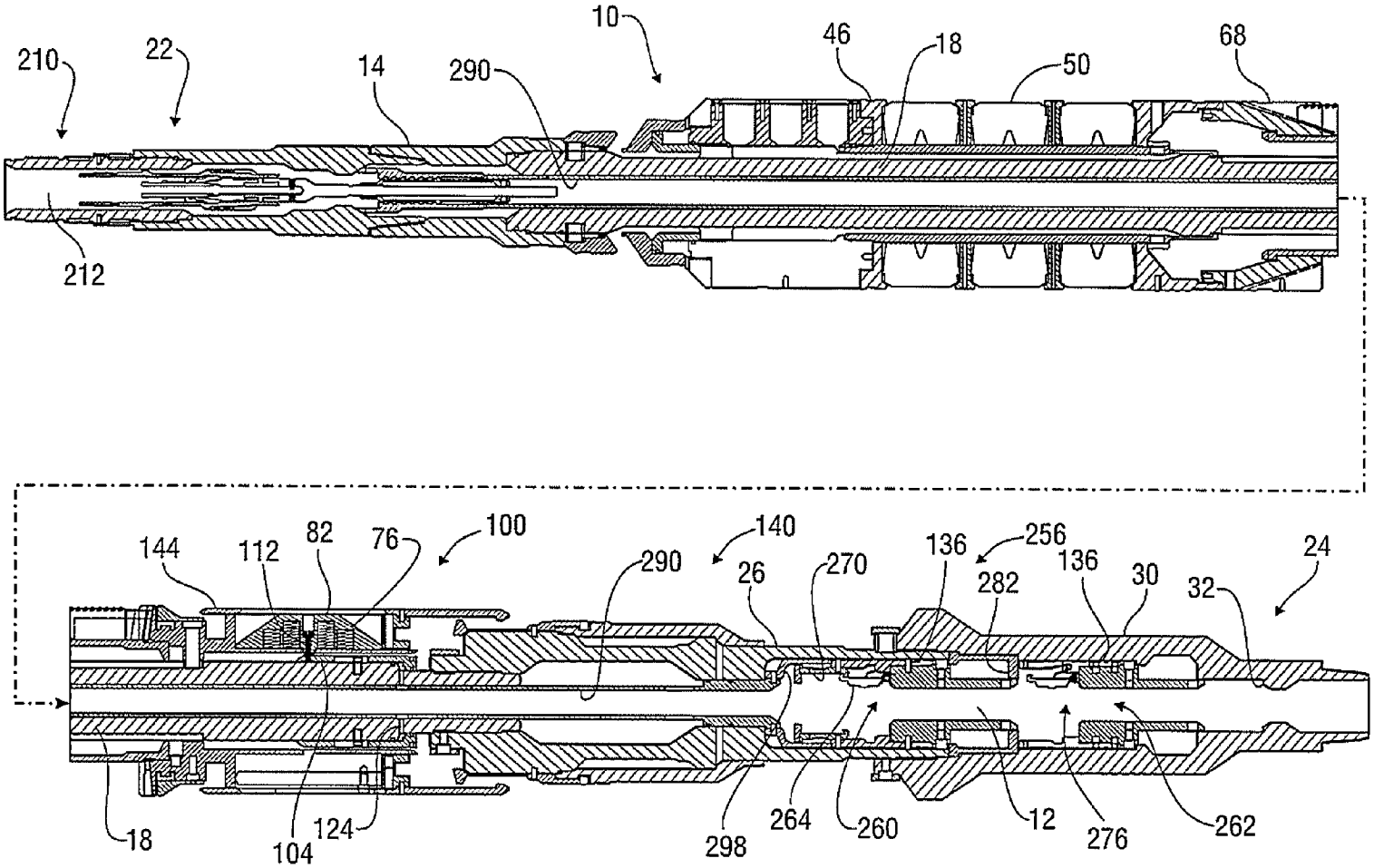
FIG. 12 is a cross-sectional view of an exemplary packer assembly having remotely actuated drag blocks in accordance with another embodiment of the present disclosure.
Figure 13:
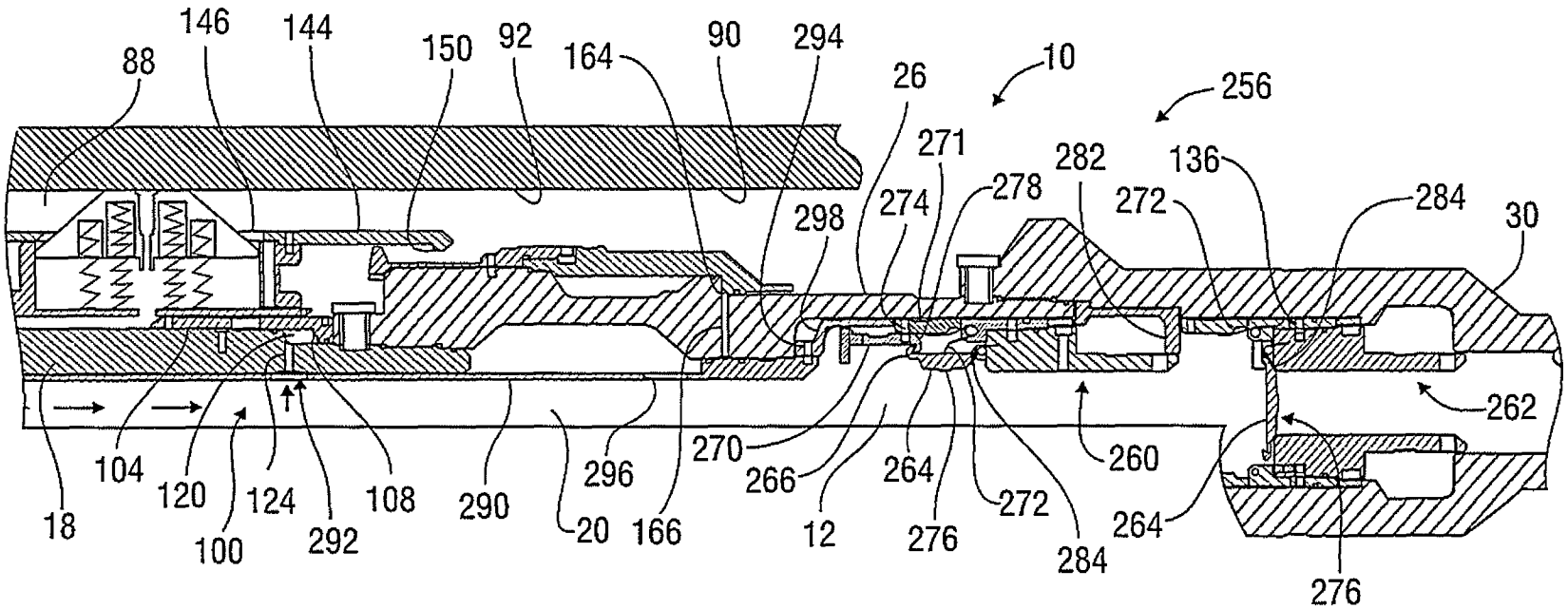
FIG. 13 is a partial cross-sectional view of some components associated with the remotely actuated drag blocks of the packer assembly of FIG. 12 showing the exemplary drag block in an extended position in a well bore.

In other embodiments, the retention sleeve 104 may be movable axially relative to the mandrel 18 in the "down-hole" direction (toward the lower, or distal, end 24 of the packer assembly 10 (FIG. 1)) between its "engaged" position and "disengaged" position. In the embodiment of FIGS. 12 & 13, for example, the lower end 108 of the retention sleeve 104 is exposed to the pressure chamber 120. Accordingly, the illustrated retention sleeve 104 is directly activated to slide in the down-hole direction upon pressurization (similarly as described above) of the pressure chamber 120. In this particular arrangement, a retention piston 114 (FIGS. 2-7) is not necessary.

Referring back to FIG. 3, when included, the flapper valve member 130 may have any suitable form, configuration and operation as is and becomes further known. The illustrated flapper valve member 130 is spring-biased in a seated, or closed, position (e.g. FIG. 3) and movable into an unseated, or open, position when fluid pressure from the well bore 88 acting on the bore 12 below the valve member 130 is greater than fluid pressure in the bore 12 above the member 130, such as while running the packer assembly 10 into the well. In this embodiment, the flapper valve member 130 is part of a flapper valve assembly 128 that also includes a valve seat 134. The illustrated valve seat 134 carries the valve member 130 and releasably engages the packer assembly 10, such as the bottom sub 26, via one or more releasable connector 136. The releasable connectors 136 may have any suitable form and configuration, such as shear pins, shear screws, other frangible members, snap rings, etc. In this embodiment, the releasable connectors 136 are shear screws and the application of sufficient fluid pressure (arrows 132, FIG. 4) in the bore 12 above the closed flapper valve member 130 will release, or break, the releasable connector(s) 136, disengaging the flapper valve assembly 128 from the bottom sub 26 (or other part of the packer assembly 10).

Figure 4:
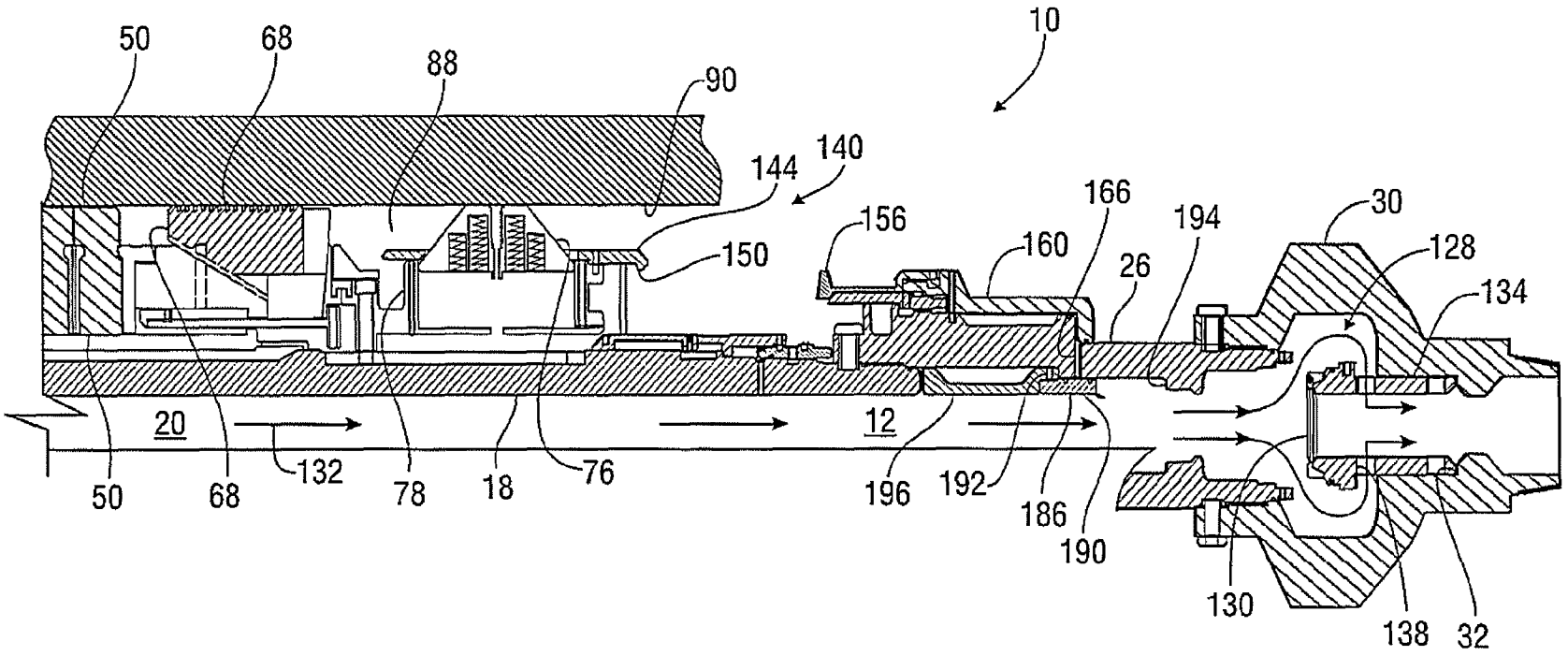
FIG. 4 is a partial cross-sectional view of some components associated with the remotely actuated drag blocks of the packer assembly of FIG. 1 in a well bore showing the exemplary flapper valve assembly disconnected from the exemplary bottom sub.

As shown in FIG. 4, in this example, the flapper valve assembly 128 will drop in the bore 12 and may rest against a ledge 32 formed in the lower guide 30 (or other part of the packer assembly 10). If desired, the illustrated valve seat 134 may include flow bypass passages 138 that allow fluid flow through the bore 12 after the valve assembly 128 drops in the bore 12.

Figure 5:
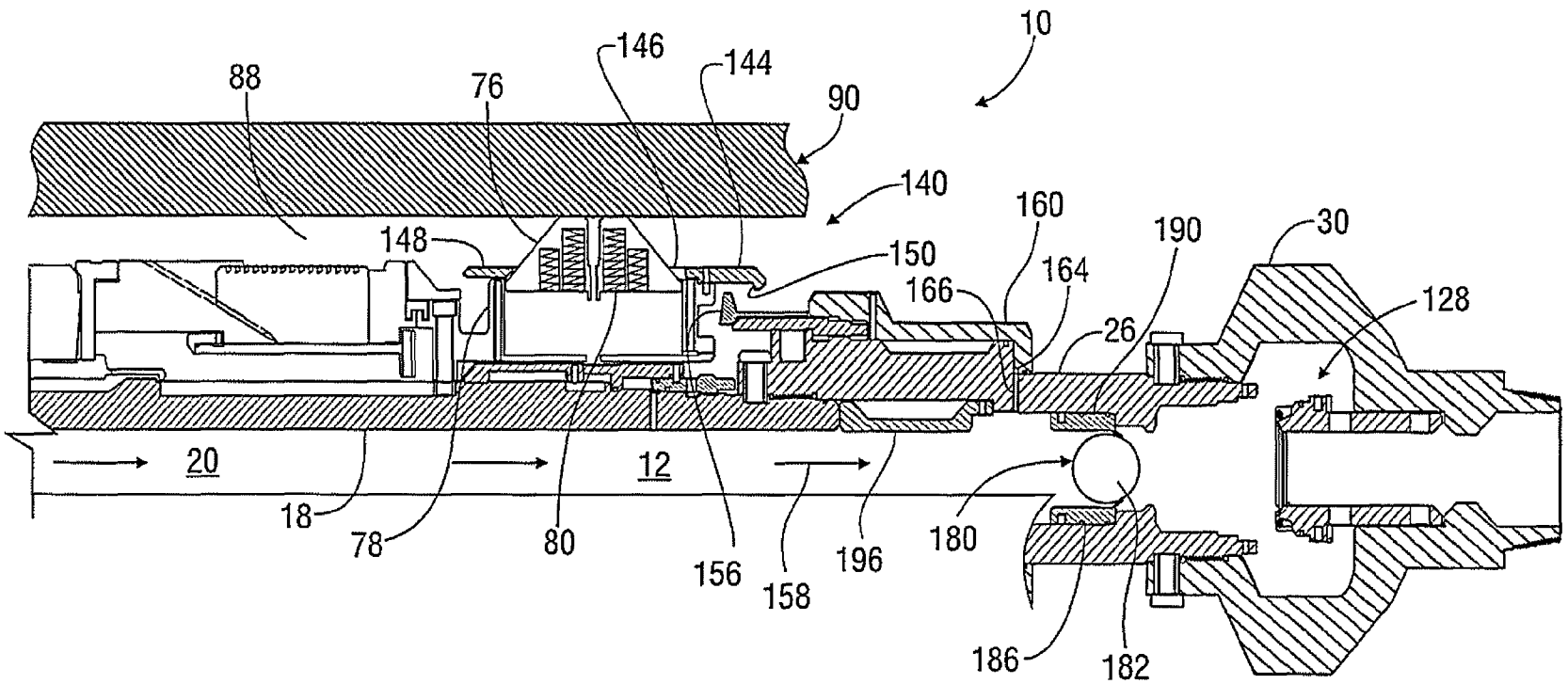
FIG. 5 is a partial cross-sectional view of some components associated with the remotely actuated drag blocks of the packer assembly of FIG. 1 in a well bore showing the exemplary ball seat disconnected from the exemplary mandrel extension.
Figure 6:
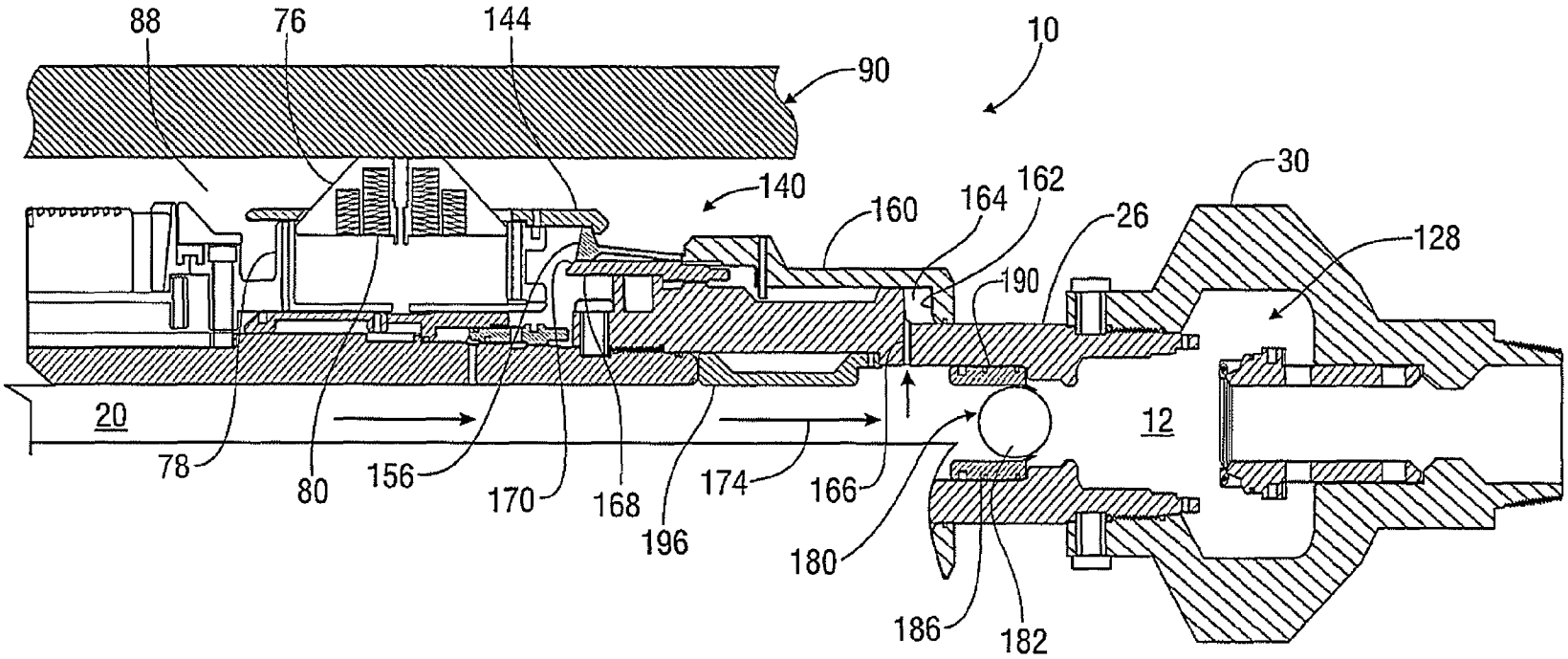
FIG. 6 is a partial cross-sectional view of some components associated with the remotely actuated drag blocks of the packer assembly of FIG. 1 in a well bore showing the exemplary retraction pressure chamber being pressurized.
Figure 7:
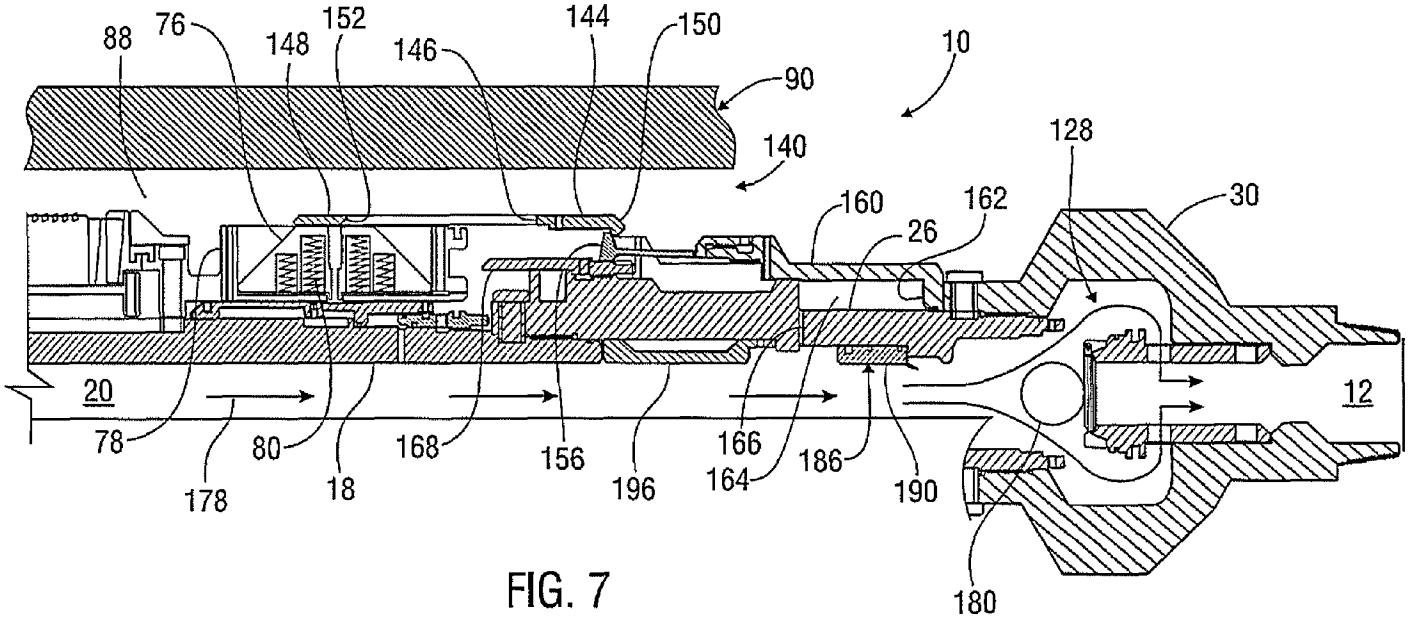
FIG. 7 is a partial cross-sectional view of some components associated with the remotely actuated drag blocks of the packer assembly of FIG. 1 in a well bore showing the exemplary drag block into a retracted position.

Referring to FIGS. 4-7, in accordance with another independent aspect of the present disclosure, each drag block 76 may be selectively movable radially inwardly relative to the mandrel 18 from an extended position to a retracted position (FIG. 7). In this embodiment, a refraction assembly 140 is provided to selectively move the drag blocks 76 from the extended position to the refracted position and thereafter retain them in the retracted position.

The retraction assembly 140 may have any suitable form, configuration and operation. As shown in FIG. 5, the illustrated refraction assembly 140 includes a tubular retraction sleeve 144 movable over the top 82 (FIG. 2) of each drag block 76. The exemplary retraction sleeve 144 includes a series of windows 146 through which the respective drag blocks 76 protrude when in an extended position. The illustrated retraction sleeve 144 is selectively axially movable relative to the mandrel 18 and drag blocks 76 in the down-hole direction from an "open" position, where the windows 146 are aligned over the drag blocks 76, to a "closed position" (FIG. 7), where the body 148 of the sleeve 144 engages and aligns over the drag blocks 76. Thus, the open position of the exemplary sleeve 144, such as shown in FIGS. 3-6, allows the drag blocks 76 to be in their extended position, while the closed position, such as shown in FIG. 7, holds the drag blocks 76 in their retracted position. Movement of the exemplary retraction sleeve 144 from its open to its closed position pushes, or biases, the drag blocks 76 into their retracted position.

Referring to FIG. 6, the refraction sleeve 144 may be selectively movable from an open to a closed position in any suitable manner. For example, the retraction system 140 may include an axially movable retraction collet 156 configured to selectively engage a lip 150 (FIG. 5) of the retraction sleeve 144 and pull or drag the sleeve 144 from an open to a closed position. The refraction collet 156 may be actuated to grab and pull the retraction sleeve 144 in any suitable manner. In this example, the retraction collet 156 extends from a retraction piston 160 that is selectively movable axially relative to the mandrel 18 in the down-hole direction upon fluid pressurization of a retraction pressure chamber 164 acting on one or more piston face 162 of the piston 160.

The retraction pressure chamber 164 may be pressurized in any suitable manner. In this example, at least one port 166 formed in the bottom sub 26 fluidly communicates with the retraction pressure chamber 164 and the central bore 12. The illustrated bore 12, port 166 and retraction pressure chamber 164 are pressurized with fluid (arrows 174) after the bore 12 is sufficiently blocked down-hole of the port 166. In this embodiment, a plug 180 is circulated or dropped into the bore 12 and seats in a catcher 186. The plug 180 and catcher 186 may have any form, configuration and operation. For example, the plug 180 may be a ball 182, or dart, and the catcher 186 may be a ball seat 190. Thus, when the illustrated plug 180 is in place on the catcher 186, the bore 12 above the plug 180, port 166 and retraction pressure chamber 164 may be selectively pressurized (e.g. from the surface) to actuate the retraction piston 160 and retraction sleeve 144.

As shown in FIG. 3, in this embodiment, the catcher 186 is initially held in place in the bore 12 over the port 166, such as with the use of one or more releasable connector 192, to prevent premature pressurization of the retraction pressure chamber 164. The releasable connectors 192 may have any suitable form and configuration, such as shear pins, shear screws, other frangible members, snap rings, etc. The illustrated releasable connector 192 is a shear pin that releasably connects the catcher 186 to a mandrel extension 196 disposed in the bore 12 down-hole of the mandrel 18. However, the releasable connector(s) 192 could instead releasably connect the catcher 186 to any other suitable component, such as directly to the mandrel 18.

As shown in FIG. 5, after the exemplary ball 182 seats in the ball seat 190, the bore 12 may be pressurized (fluid flow arrows 158) above the ball seat 190 sufficient to shear the releasable connector(s) 192 (FIG. 3) and drive the ball seat 190 down-hole in the bore 12, exposing the port(s) 166. In this embodiment, the ball seat 190 will move from the position shown in FIG. 3 to the position shown in FIG. 5 and rest against a ledge 194 (FIG. 3).

Figure 8:
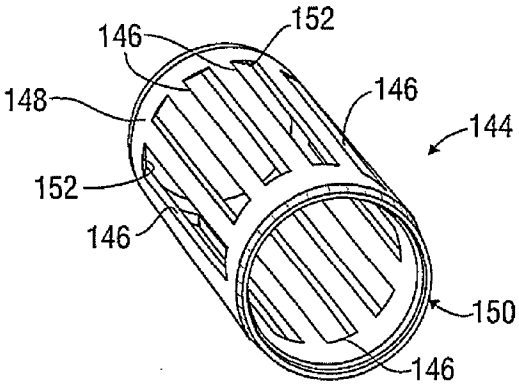
FIG. 8 is a perspective view of the exemplary retraction sleeve of FIG. 1.

As shown in FIG. 6, as the illustrated retraction pressure chamber 164 is pressurized, the retraction piston 160 moves in the down-hole direction, causing the collet 156 to slide up a ramp 170 on an adjacent collet support sleeve 168 from a safe, or non-engaged position, into engagement with the lip 150 (FIG. 5) of the retraction sleeve 144. The exemplary retraction piston 160 then pulls the sleeve 144 into its closed position (FIG. 7). The back edge 152 (FIG. 8) of each illustrated window 146 of the refraction sleeve 144 will engage the corresponding extended drag block 76 and push it radially inwardly toward the mandrel 18, compressing the biasing members 80. In the closed position, as shown in FIG. 7, the body 148 of the exemplary retraction sleeve 144 will hold the drag blocks 76 in their retracted position, such as for removal of the packer assembly 10 from the well or other actions. In this embodiment, further pressurization of the bore 12 (fluid flow arrows 178) will urge the plug 180 through the catcher 186 and down into the bore 12, opening the bore 12 to allow fluid flow therethrough.

Figure 9:
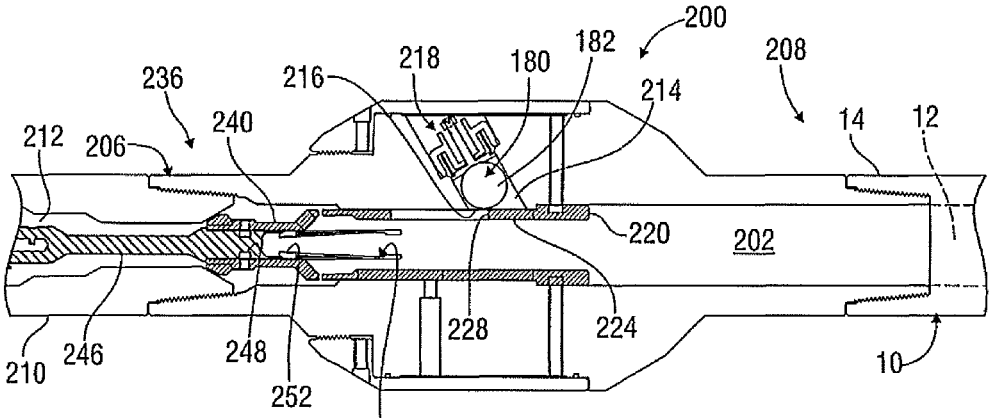
FIG. 9 is a partial cross-sectional view of some components of an exemplary ball launcher in accordance with an embodiment of the present disclosure.

Now referring to FIG. 9, in another independent aspect of the present disclosure, in some applications, a ball launcher assembly 200 may be used to insert the ball 182 (or other plug 180) into the bore 12 of the packer assembly 10. This may be desirable, for example, if another tool or component, such as the hurricane valve of U.S. Pat. No. 7,854,268 is coupled to the upper end of the packer assembly 10 (or other downhole tool) and prevent the insertion of a ball 182 or other plug 180 from the surface (not shown) into the bore 12. U.S. Pat. No. 7,854,268 to Lehr et al., entitled "Deep Water Hurricane Valve" and issued on Dec. 21, 2010, which is owned by the same Assignee as the present patent, is incorporated herein by reference in its entirety.

The ball launcher 200 may have any suitable form, configuration and operation. In this instance, the ball launcher 200 has an upper end 206 connectable to the other component, or tool, 210, such as the hurricane valve described in U.S. Pat. No. 7,854,268, and a lower end 208 connectable to the packer assembly 10. A bore 202 of the exemplary launcher 200 aligns with a bore 212 of the other tool 210 and the bore 12 of the packer assembly 10. The plug 180, such as the ball 182, is provided in a launch cavity 214 formed in the illustrated launcher 200. The exemplary launch cavity 214 has an opening 216 into the bore 202. In this example, the launcher 200 also includes a spring-actuated piston 218 configured to launch the ball 182 through the opening 216, into the bore 202 and ultimately into the central bore 12 of the packer assembly 10.

Figure 10:
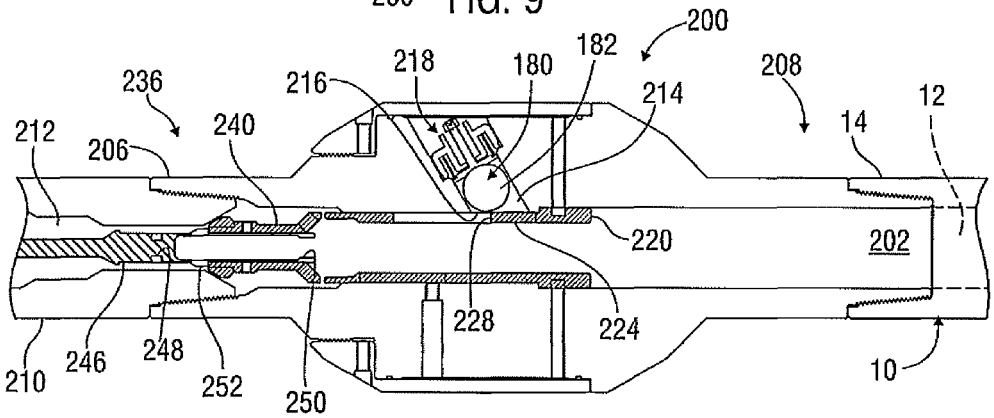
FIG. 10 is a partial cross-sectional view of some components of the ball launcher of FIG. 9 showing the exemplary collet assembly engaged with the exemplary actuator sleeve.

Still referring to the embodiment of FIG. 9, a ball retaining sleeve 220 is provided in the bore 202 over the opening 216 of the launch cavity 214. The exemplary sleeve 220 includes a body 224 and at least one window 228, and is selectively slideable axially in the down-hole direction (in the direction of the packer assembly 10) from a closed position (FIG. 9-10) to an open position (FIG. 11) relative to the opening 216. In the closed position, the body 224 of the illustrated sleeve 220 blocks the opening 216, retaining the ball 182 in the launch cavity 214. This position would typically be preferred until it is desired to launch the ball 182. In the open position (FIG. 11), the window 228 of the ball retaining sleeve 220 aligns with the opening 216 of the launch cavity 214, allowing the ball 182 to be launched.

Referring back to FIG. 9, the ball retaining sleeve 220 may be movable from its closed position to its open position in any suitable manner. For example, a ball retaining sleeve actuator assembly 236 may be used to selectively move the sleeve 220. The ball retaining sleeve actuator assembly 236 may have any suitable form, configuration and operation. In this example, the assembly 236 includes an actuator sleeve 240 disposed at least partially within the bore 202 of the launcher 200 up-hole of the ball retaining sleeve 220. The illustrated actuator sleeve 240 is engageable with the ball retaining sleeve 220 and configured to selectively push the sleeve 220 in the down-hole direction from its closed position to its open position.

The actuator sleeve 240 may be movable into engagement with the ball retaining sleeve 220 in any suitable manner. In this embodiment, the actuator sleeve 240 is driven by a rod 246 extending from the bore 212 of the other tool 110 into the bore 202 of the ball launcher 200. The exemplary rod 246 carries a collet assembly 250 and is initially releasably engaged with the actuator sleeve 240, such as with one or more releasable connector 248, prior to actuation of the actuator sleeve 240. The releasable connector(s) 248 may have any suitable form and configuration, such as shear pins, shear screws, other frangible members, snap rings, etc. In this embodiment, the releasable connectors 248 are shear pins.

Figure 11:
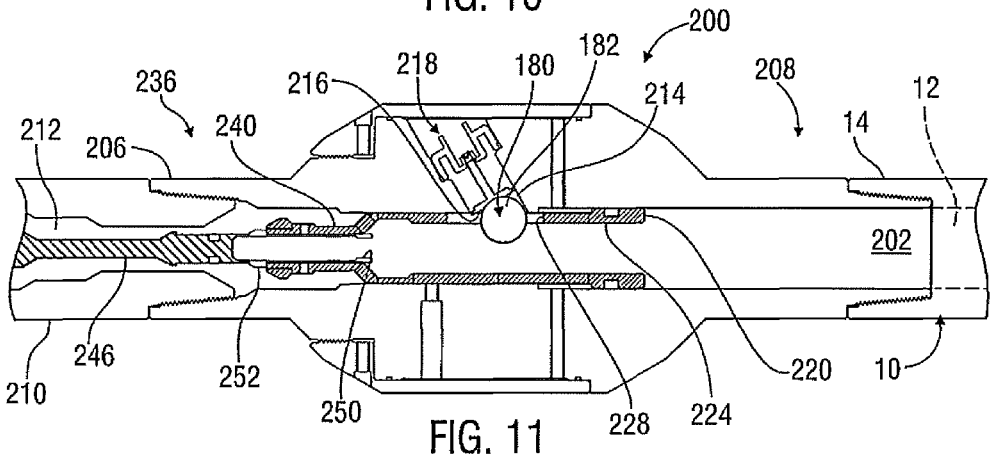
FIG. 11 is a partial cross-sectional view of some components of the ball launcher of FIG. 9 showing the exemplary actuator sleeve engaged with the exemplary ball retention sleeve.

Now referring to FIG. 11, when it is desired to move the exemplary ball retaining sleeve 220 into an open position, the illustrated rod 246 is first pulled upwardly in the bores 202, 212 sufficient to disengage or break the releasable connectors 248 (FIG. 9), allowing the compressed, outwardly-biased collets 252 of the collet assembly 250 to expand into engagement with the actuator sleeve 240. Thereafter, as shown in FIG. 11, the illustrated rod 246 and engaged actuator sleeve 240 may be moved in the down-hole direction in the bore 202 so that the actuator sleeve 240 engages and pushes the ball retaining sleeve 220 from its closed to open positions. It should be understood that, in other embodiments, the ball retaining sleeve 220, actuator sleeve 240 and rod 246 may operate similarly but be configured to move in the opposite direction to allow launching of the plug 180. Further, the ball launcher 200 may be used in other downhole tools requiring the use of a ball 182, dart or other type of plug 180, whether or not the tool includes drag blocks 76 or a drag block retention or retraction system 100, 140.

In accordance with another independent aspect of the present disclosure, in some embodiments, the retraction pressure chamber 164 may be pressurized without the use of a ball 182 or other plug 180 and associated ball seat 190 or catcher 186. For example, referring to FIG. 12 (showing the packer assembly 10 in the run-in position), a dual flapper system 256 is utilized. The dual flapper system 256 includes an upper flapper valve assembly 260 and a lower flapper valve assembly 262. The upper and lower flapper valve assemblies 260, 262 may have any suitable form, configuration and operation. For example, the valve assemblies 260, 262 may be the same or similar in construction, configuration and operation as the flapper valve assembly 128 described above with respect to FIGS. 1-7.

Figure 16:
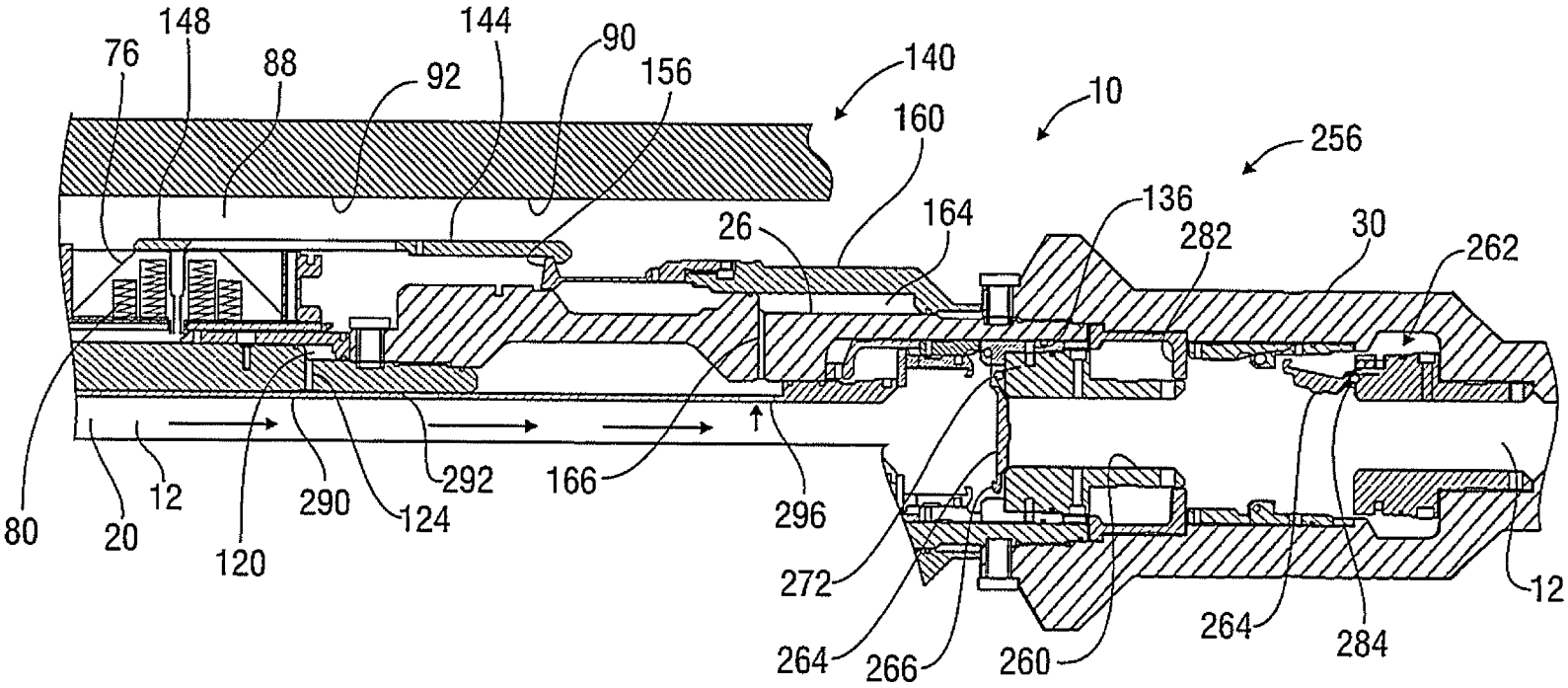
FIG. 16 is a partial cross-sectional view of some components associated with the remotely actuated drag blocks of the packer assembly of FIG. 12 in a well bore showing the exemplary drag block into a retracted position.

In this embodiment, the upper flapper valve assembly 260 is releasably mounted to the bottom sub 26 (or other component contained therein) with one or more releasable connector 136, and serves the same purpose as the plug 180, or ball 182, as described above. The lower flapper valve assembly 262 is releasably engaged to the lower guide 30 (or other component contained therein) with one or more releasable connector 136, and serves the same purpose as the flapper valve assembly 128 described above. The illustrated upper flapper valve assembly 260 is thus positioned above or, up-hole of, the lower flapper valve assembly 262, and includes a flapper valve member 264 that may be held open until it is desired to pressurize the retraction pressure chamber 164 (FIG. 16). Thereafter, the upper flapper valve member 264 may be allowed to be closed across the bore 12 and allow pressurization of the retraction pressure chamber 164.

The upper flapper valve member 264 may be held in its open position and allowed to thereafter close in any suitable manner. Referring to FIG. 13, in this embodiment, the flapper valve member 264 is held in its open position by a releasable locking sleeve 270. The exemplary locking sleeve 270 is disposed in the bore 12 above the valve member 264 and releasably connected to a ring 271 in the bottom sub 26 (or other component), such as with one or more releasable connector 274. The releasable connector(s) 274 may have any suitable form and configuration, such as shear pins, shear screws, other frangible members, snap rings, etc. In this embodiment, the releasable connector 274 is a shear pin.

Still referring to FIG. 13, the illustrated locking sleeve 270 includes a coupler 278 that releasably engages the upper flapper valve member 264. In this example, the coupler 278 is a hook that engages a corresponding coupler 266, such as a hook, extending from the upper flapper valve member 264. However, any other form of releasable engagement between the sleeve 270 and member 264 may be used. The coupler 278 thus holds the upper flapper valve member 264 in an open position. The relationship and position of the exemplary flapper valve member 264 and locking sleeve 270 shown in FIG. 13 may be maintained, for example, until it is desired to pressurize the refraction pressure chamber 164 (FIG. 16).

In this embodiment, a control sleeve 290 is used to release the locking sleeve 270 from the flapper valve member 264 and allow the valve member 264 to bias into a closed position across the bore 12. The control sleeve 290 may have any suitable form, configuration and operation. As shown in FIG. 12, the control sleeve 290 extends into the bore 12 from above the packer assembly 10. For example, the control sleeve 290 may be provided by, or through, a separate tool, or component, 210 coupled to the upper end 22 of the packer assembly 10, such as the hurricane valve described in U.S. Pat. No. 7,854,268.

Figure 14:
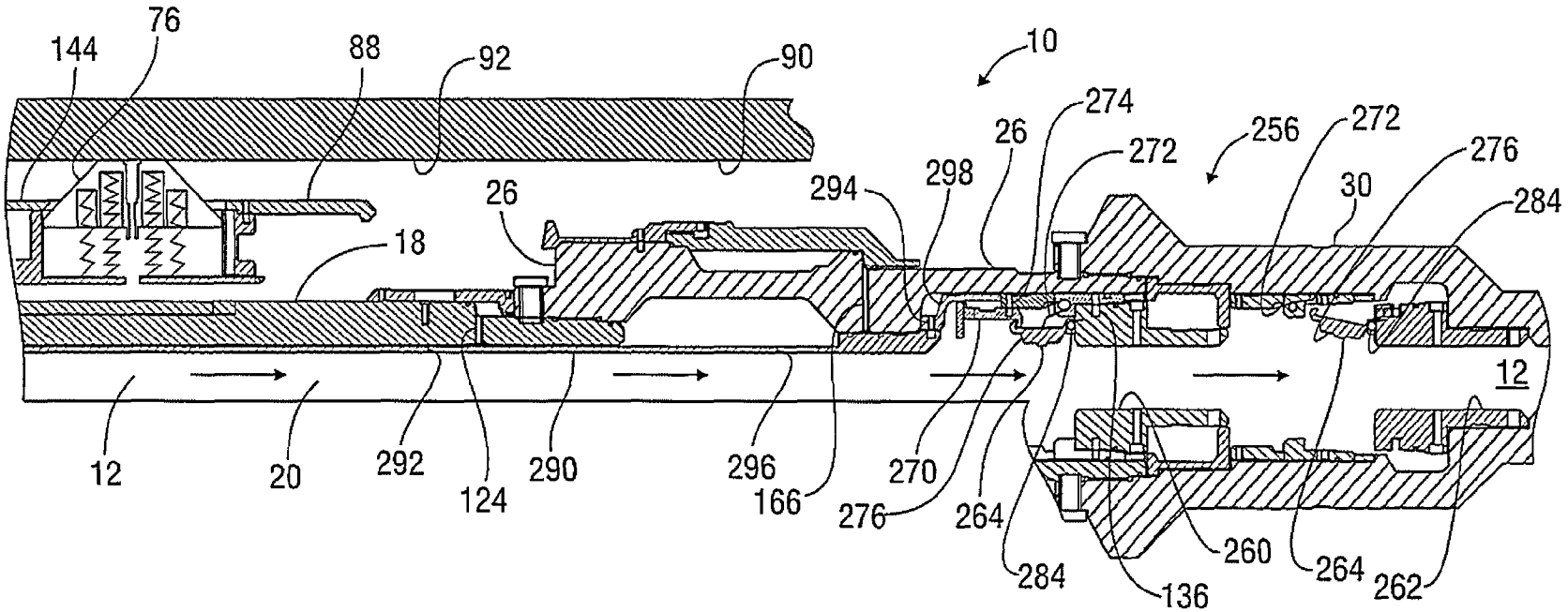
FIG. 14 is a partial cross-sectional view of some components associated with the remotely actuated drag blocks of the packer assembly of FIG. 12 in a well bore showing the exemplary lower flapper valve assembly disconnected from the exemplary lower guide.

Referring back to FIG. 13, the exemplary control sleeve 290 is temporarily held in a first position relative to the mandrel 18 in the bore 12 above the locking sleeve 270. For example, one or more releasable connector(s) 294 may be releasably engaged between the control sleeve 290 and a spacer sleeve 298 (or other component). The releasable connector(s) 294 may have any suitable form and configuration, such as shear pins, shear screws, other frangible members, snap rings, etc. In this embodiment, the releasable connector 294 is a shear screw. If the packer assembly 10 includes a drag block retention system 100, at least one port, or cut-out, 292 formed in the exemplary control sleeve 290 aligns with the port(s) 124 in the mandrel 18 to allow pressurization of the pressure chamber 120, such as described above. At the same time, the illustrated control sleeve 290 in the first position blocks the port 166, preventing accidental pressurization of the retraction pressure chamber 164. As shown in FIG. 14, further pressurization of the illustrated bore 12 will disengage the releasable connector(s) 136 anchoring the lower flapper valve assembly 262, allowing the assembly 262 to drop in the bore 12, similarly as described above with respect to flapper valve assembly 128 of FIG. 1-7.

Figure 15:
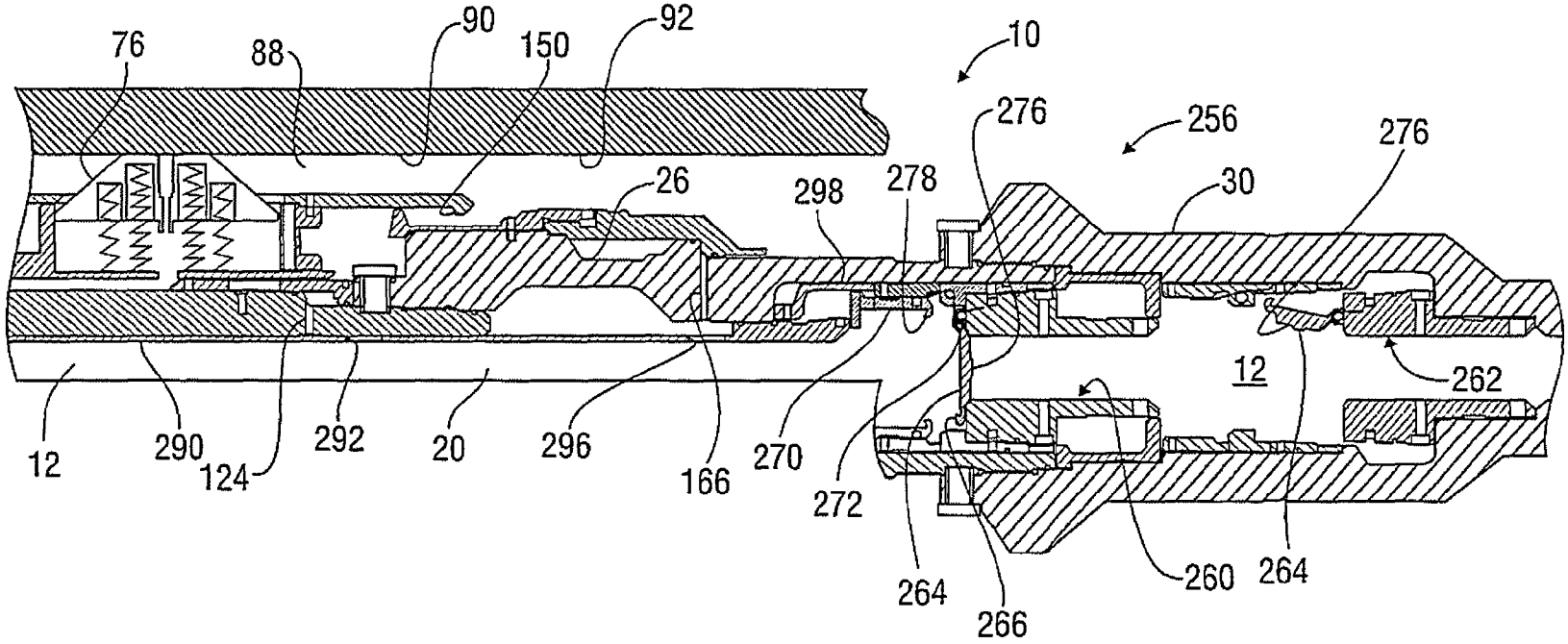
FIG. 15 is a partial cross-sectional view of some components associated with the remotely actuated drag blocks of the packer assembly of FIG. 12 in a well bore showing the exemplary flapper valve member of the exemplary upper flapper valve assembly in a closed or seated position.

Sufficient axial movement of the exemplary control sleeve 290 will release the releasable connector 294, disengaging the control sleeve 290 from the spacer 298 (or other component). As shown in FIG. 15, the illustrated control sleeve 290 may thereafter be moved axially in the bore 12 in the down-hole direction into contact with the locking sleeve 270. Continued movement of the exemplary control sleeve 290 and locking sleeve 270 in the down-hole direction will (i) release the releasable connector(s) 274 (FIG. 14), disengaging the locking sleeve 270 from the ring 271 (or other component) and (ii) disengage the coupler 278 of the locking sleeve from the coupler 266 of the flapper valve member 264. The illustrated flapper valve member 264 will spring-bias into its seated, or closed, position across the bore 12, allowing pressurization of the bore 12 above the upper flapper valve assembly 260.

Referring to FIG. 16, in this (second) position of the illustrated control sleeve 290, one or more ports, or cut-outs, 296 formed therein will align with the port(s) 166, allowing fluid pressurization of the refraction pressure chamber 164. Thereafter, such as after the exemplary drag blocks 76 are moved to a retracted position, the bore 12 may be opened for fluid flow therein by increasing pressure therein to release the releasable connectors 136, disengaging the upper flapper valve assembly 260 from the bottom sub 26 (or other component). The illustrated upper flapper valve assembly 260 will thereafter drop in the bore 12. In this embodiment, the upper flapper valve assembly 260 will rest against a ledge 282 and allow fluid flow through the bore 12. It should be understood that the dual flapper system 256 may be used in other downhole tools, whether or not the tool includes drag blocks 76 or a drag block retention or retraction system 100, 140.

Referring again to FIG. 13, if desired, the exemplary upper and/or lower flapper valve assemblies 260, 262 may be configured so that after they drop within the bore 12 of the packer assembly 10, their respective flapper valve members 264 will not remain in a closed, or seated, position. The flapper valve members 264 may move into a non-seated position in any suitable manner. For example, the flapper valve members 264 may be dual-biased flappers 276. In this embodiment, as shown in FIG. 13, each flapper valve assembly 260, 262 is equipped with both a primary biasing member 272 that normally biases the respective flapper valve members 264 into a closed position, and a secondary biasing member 284 acting on the flapper valve member 264 in the opposite direction. The biasing members 272 and 284 may have any suitable form, configuration and operation and is and becomes further known. For example, the biasing members 272, 284 may be torsion springs.

However, the biasing forces of each exemplary secondary biasing member 284 are weaker than the biasing forces of the associated respective primary biasing member 272, allowing the primary biasing members 272 to bias the flapper valve members 264 in the closed, or seated, position when desired as described above. For example, when either exemplary flapper valve member 264 is not affected by greater fluid forces acting on the bottom side thereof, the greater biasing forces of the primary biasing member 272 overcome the opposing biasing forces of the weaker secondary biasing member 284. This effect is shown with respect to the lower flapper valve assembly 262 in FIG. 13, and with respect to the upper flapper valve assembly 260 in FIG. 15.

Referring now to FIG. 14, when either of illustrated flapper valve assemblies 260, 262 drops in the bore 12, its primary biasing member 272 becomes disabled, or disengages from, the associated flapper valve member 264. In that position, the primary biasing member 272 no longer biases the flapper valve member 264 into a closed, or seated, position. As shown with respect to the lower flapper valve assembly 262, the exemplary secondary biasing member 284 then biases the flapper valve member 264 into the open, or unseated, position, allowing fluid flow thereby in the bore 12. It should be understood that the flapper valve assembly 128 described above with respect to FIGS. 1-7 may be a dual-biased flapper 276, as described herein. Further, the dual-biased flapper 276 as described herein may be used in other downhole tools, whether or not the tool includes drag blocks 76 or a drag block retention or retraction system 100, 140.

In some embodiments, a packer assembly 10 or other downhole tool may include a drag block retention system 100, a retraction system 140 or both. For example, the inclusion of a drag block retention system 100, a retraction system 140 or both may be useful when deployed on a storm packer, used in connection with a hurricane plug, squeezing a wet shoe and/or other applications.

In accordance with embodiments of the present disclosure, a packer assembly 10 or other downhole tool equipped with a drag block retention system 100 may be deployed to and into a well bore 88 with the drag blocks 76 in the retracted position. The drag blocks 76 may thereafter be moved to an extended position upon command from the surface. This may be beneficial, for example, to avoid the drag blocks 76 becoming hung-up on, or damaging, other equipment or components included in their path during deployment to the desired destination(s), or becoming damaged themselves. In a subsea well scenario, for example, the packer assembly 10 or other downhole tool may be deployed through a long riser extending from a floating vessel to the sea floor, through a flex joint and various components at or near the well head on the sea floor (e.g. blow-out-preventers, casing hanger(s), Christmas tree, production control equipment), and then through thousands of feet of casing in the underground well 88. In a refracted position, the drag blocks 76 will be more likely to avoid damaging or getting hung-up in the myriad of seals, shoulders, ledges, profiles and other shapes, turns and angles normally included along this route, and particularly at the subsea well head.

If the packer assembly 10 or other downhole tool includes a retraction system 140 in accordance with the present disclosure, its drag blocks 76 may be moved to a retracted position after their deployment in the well bore 88, such as after use of the packing elements 50 or other features of the tool. In such instance, the same mishaps as described above could be avoided during retrieval (or repositioning) of packer assembly 10 or other downhole tool.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. A packer assembly for use in an oil and gas well having a well bore, the packer assembly comprising:

a tubular mandrel having an upper end and a lower end, said upper end being disposed up-hole of said lower end in the well bore when the packer assembly is disposed therein;

a central bore extending at least through said mandrel from the upper end to the lower end thereof;

a plurality of drag blocks associated with said mandrel, each said drag block being mounted in a corresponding drag block housing, each said drag block being configured to be movable radially outwardly relative to said mandrel from a retracted position to an extended position, each said drag block in said retracted position being disposed proximate to said associated drag block housing and spaced away from the well bore wall when the packer assembly is disposed therein, and each said drag block in said extended position being disposed radially outwardly of said associated drag block housing and engageable with the well bore wall when the packer assembly is disposed therein, said drag blocks being held in said retracted position when the packer assembly is inserted into the well bore;

at least one selectively-actuated retention sleeve disposed between said mandrel and said drag blocks; and a plurality of retainers, at least one said retainer connecting each said drag block in said retracted position to said retention sleeve and configured to disconnect from said associated drag block and/or said retention sleeve and allow said associated drag block to move from said retracted position to said extended position upon actuation of said retention sleeve when the packer assembly is positioned at a desired location in the well bore, wherein said retention sleeve is configured to be movable axially between an engaged position and a disengaged position, said retention sleeve in said engaged position being engaged with said plurality of retainers and said drag blocks when said drag blocks are in said retracted position, said retention sleeve in said disengaged position being disconnected from said drag blocks, said retention sleeve being configured to disengage each said retainer from said connected drag block and/or said retention sleeve when said retention sleeve is moved from said engaged position to said disengaged position.

2. The packer assembly of claim 1 wherein said retention sleeve is moveable axially in one direction and each said retainer is at least one among a shear pin and a shear screw.

3. The packer assembly of claim 2 further including at least one retention piston axially aligned and engageable with said retention sleeve and configured to be selectively axially movable relative to said mandrel in one direction in response to fluid pressure acting on one side thereof, said retention piston being configured to move said retention sleeve from said engaged position to said disengaged position.

4. The packer assembly of claim 1 further including upper and lower flapper valve assemblies disposed within said central bore, said upper flapper valve assembly being disposed up-hole of said lower flapper valve assembly in said central bore;

at least a first releasable connector retaining said upper flapper valve assembly in a fixed position relative to said central bore, and at least a second releasable connector retaining said lower flapper valve assembly in a fixed position relative to said central bore;

each of said upper and lower flapper valve assemblies including a flapper valve member, each said flapper valve member being pivotably movable across said central bore between an open and a closed position, each said flapper valve member in said open position being configured to not block the flow of fluid in said central bore and, in said closed position, configured to block the flow of fluid in said central bore from above said flapper valve member;

at least a first primary biasing member associated with said lower flapper valve assembly and configured to bias said flapper valve member thereof into said closed position when the packer assembly is initially deployed in the well bore and moved to a desired stationary location therein;

said second releasable connector being configured to release said lower flapper valve assembly from said fixed position upon sufficient fluid pressurization of said central bore above said lower flapper valve assembly, said flapper valve member of said lower flapper valve assembly being configured not to block the flow of fluid in said central bore after said lower flapper valve assembly is released from said fixed position;

a locking sleeve disposed within said central bore proximate to said upper flapper valve assembly, said locking sleeve being releasably engaged with said flapper valve member of said upper flapper valve assembly and configured to hold said flapper valve member of said upper flapper valve assembly in said open position when the packer assembly is deployed into the well bore, said locking sleeve being selectively actuated to disengage from said flapper valve member of said upper flapper valve assembly; and at least a second primary biasing member associated with said upper flapper valve assembly and configured to bias said flapper valve member thereof into said closed position upon disengagement said flapper valve member of said upper flapper valve assembly from said locking sleeve.

5. The packer assembly of claim 4 further including a control sleeve extending into said central bore from said upper end of said mandrel, said control sleeve being configured to engage and actuate said locking sleeve.

6. The packer assembly of claim 4 further including a first secondary biasing member acting on said flapper valve member of said lower flapper valve assembly in the opposite direction as said first primary biasing member, said first secondary biasing member having weaker biasing forces than said first primary biasing member and configured to bias said flapper valve member of said lower flapper valve assembly into said open position after said lower flapper valve assembly is released from said fixed position.

7. The packer assembly of claim 6 wherein said first releasable connector is configured to release said upper flapper valve assembly from said fixed position upon sufficient fluid pressurization of said central bore above said upper flapper valve assembly after said flapper valve member thereof is moved into said closed position, further including a second secondary biasing member acting on said flapper valve member of said upper flapper valve assembly in the opposite direction as said second primary biasing member, said second secondary biasing member having weaker biasing forces than said second primary biasing member and configured to bias said flapper valve member of said upper flapper valve assembly into said open position after said upper flapper valve assembly is released from said fixed position.

8. A packer assembly for use in an oil and gas well having a well bore, the packer assembly comprising:

a tubular mandrel having an upper end and a lower end, said upper end being disposed up-hole of said lower end in the well bore when the packer assembly is disposed therein;

a central bore extending at least through said mandrel from the upper end to the lower end thereof;

a plurality of drag blocks associated with said mandrel, each said drag block being mounted in a corresponding drag block housing, each said drag block being configured to be movable radially outwardly relative to said mandrel from a retracted position to an extended position, each said drag block in said retracted position being disposed proximate to said associated drag block housing and spaced away from the well bore wall when the packer assembly is disposed therein, and each said drag block in said extended position being disposed radially outwardly of said associated drag block housing and engageable with the well bore wall when the packer assembly is disposed therein, said drag blocks being held in said retracted position when the packer assembly is inserted into the well bore;

at least one selectively-actuated retention sleeve disposed between said mandrel and said drag blocks;

a plurality of retainers, at least one said retainer connecting each said drag block in said retracted position to said retention sleeve and configured to disconnect from at least one among said associated drag block and/or said retention sleeve and allow said associated drag block to move from said retracted position to said extended position upon actuation of said retention sleeve when the packer assembly is positioned at a desired location in the well bore; and at least one retraction sleeve engageable over said drag blocks and selectively axially movable relative thereto from an open position to a closed position, said retraction sleeve having a plurality of windows formed therein and being configured in said open position to allow said drag blocks in said extended position to extend through said windows, said retraction sleeve in said closed position being configured to retain said drag blocks in said retracted position.

9. The packer assembly of claim 8 wherein, as said retraction sleeve moves from said open to said closed positions, said retraction sleeve is configured to bias said drag blocks from said extended position into said retracted position when the packer assembly is disposed within the well bore.

10. The packer assembly of claim 8 further including at least one retraction piston releasably engageable with said retraction sleeve and selectively axially movable relative to said mandrel, said retraction piston being in fluid communication with said central bore and pressure-actuated to move said retraction sleeve from said open position to said closed position.

11. The packer assembly of claim 10 wherein said retraction piston is axially movable in the down-hole direction, further including at least one collet associated with said retraction piston, said at least one collet being configured to releasably grip said retraction sleeve and pull said retraction sleeve in the down-hole direction from said open position to said closed position as said retraction piston moves axially relative to said mandrel.

12. The packer assembly of claim 10 further including a ball and a ball seat, said ball seat being disposed in said central bore so that when said ball is dropped into said ball seat, said ball will land in said ball seat and block the flow of fluid in said central bore from above said ball seat, allowing fluid pressurization of said central bore.

13. The packer assembly of claim 12 further including a ball launcher associated with said upper end of said mandrel, said ball launcher including an upper end, a lower end and a bore extending therebetween, said bore in fluid communication with said central bore;

a ball launch cavity having an opening into said bore of said ball launcher and configured to releasably retain said ball therein and allow said ball to be launched therefrom through said opening into said bore of said ball launcher and thereafter into said central bore; and a ball retaining sleeve, said ball retaining sleeve being moveable axially in said bore of said ball launcher relative to said ball launch cavity between a closed position and an open position, said ball retaining sleeve in said closed position configured to least partially block said opening of said ball launch cavity to prevent launching of said ball into said central bore, said ball retaining sleeve in said open position configured to allow said ball to travel from said ball launch cavity into said bore of said ball launcher and into said central bore.

14. The packer assembly of claim 13 further including an actuator sleeve axially moveable at least partially within said bore of said ball launcher and configured to selectively push said ball retaining sleeve from said closed to said open position; and a rod extending into said bore of said ball launcher from said upper end thereof, said rod being configured to move said actuator sleeve axially in said bore of said ball launcher.

15. The packer assembly of claim 14 further including at least one collet disposed upon said rod and selectively engageable with said actuator sleeve, said at least one collet configured to engage said actuator sleeve upon up-hole movement of said rod in said bore of said ball launcher.

16. A packer assembly for use in an oil and gas well having a well bore, the packer assembly comprising:

a tubular mandrel having an upper end and a lower end, said upper end being disposed up-hole of said lower end in the well bore when the packer assembly is disposed therein;

a central bore extending at least through said mandrel from the upper end to the lower end thereof;

a plurality of drag blocks associated with said mandrel, each said drag block being mounted in a corresponding drag block housing, each said drag block being configured to be movable radially inwardly relative to said mandrel from an extended position to a retracted position, each said drag block in said extended position being disposed radially outwardly of said associated drag block housing and engageable with the well bore wall when the packer assembly is disposed therein, and each said drag block in said retracted position being disposed proximate to said associated drag block housing and spaced away from the well bore wall when the packer assembly is disposed therein; and at least one retraction sleeve engageable over said drag blocks and selectively axially movable relative thereto from an open position to a closed position, said retraction sleeve having a plurality of windows formed therein and being configured in said open position to allow said drag blocks in said extended position to extend through said windows, said retraction sleeve in said closed position being configured to retain said drag blocks in said retracted position, wherein as said retraction sleeve moves from said open to said closed positions, said retraction sleeve is configured to bias said drag blocks from said extended position into said retracted position when the packer assembly is disposed within the well bore.

17. The packer assembly of claim 16 further including at least one retraction piston releasably engageable with said retraction sleeve and selectively axially movable relative to said mandrel, said retraction piston being in fluid communication with said central bore and pressure-actuated to move said retraction sleeve from said open position to said closed position.

18. The packer assembly of claim 17 wherein said retraction piston is axially movable in the down-hole direction, further including at least one collet associated with said retraction piston, said at least one collet being configured to releasably grip said retraction sleeve and pull said retraction sleeve in the down-hole direction from said open position to said closed position as said retraction piston moves axially relative to said mandrel.

19. A downhole tool for use in an oil and gas well having a well bore, the downhole tool comprising:

a tubular mandrel having an upper end and a lower end, said upper end being disposed up-hole of said lower end in the well bore when the downhole tool is disposed therein;

a central bore extending at least through said mandrel from the upper end to the lower end thereof;

a plurality of drag blocks associated with said mandrel, each said drag block being mounted in a corresponding drag block housing, each said drag block being configured to be movable radially relative to said mandrel between a retracted position and an extended position, each said drag block in said retracted position being disposed proximate to said associated drag block housing and spaced away from the well bore wall when the downhole tool is disposed therein, and each said drag block in said extended position being disposed radially outwardly of said associated drag block housing and engageable with the well bore wall when the downhole tool is disposed therein, said drag blocks being held in said retracted position when the downhole tool is inserted into the well bore;

a selectively-actuated retention sleeve disposed between said mandrel and said drag blocks;

a plurality of retainers, at least one said retainer connecting each said drag block in said retracted position to said retention sleeve and configured to disconnect from at least one among said associated drag block and said retention sleeve and allow said associated drag block to move from said retracted position to said extended position upon actuation of said retention sleeve when the downhole tool is positioned at a desired location in the well bore; and a retraction sleeve engageable over said drag blocks and selectively axially movable relative thereto from an open position to a closed position, said retraction sleeve having a plurality of windows formed therein and being configured in said open position to allow said drag blocks in said extended position to extend through said windows, said retraction sleeve in said closed position being configured to retain said drag blocks in said retracted position.

20. The downhole tool of claim 19 further including a ball and a ball seat, said ball seat being disposed in said central bore so that when said ball is dropped into said ball seat, said ball will land in said ball seat and block the flow of fluid in said central bore from above said ball seat, allowing fluid pressurization of said central bore.

21. The downhole tool of claim 20 further including a ball launcher associated with said upper end of said mandrel, said ball launcher including an upper end, a lower end and a bore extending therebetween, said bore in fluid communication with said central bore;

a ball launch cavity having an opening into said bore of said ball launcher and configured to releasably retain said ball therein and allow said ball to be launched therefrom through said opening into said bore of said ball launcher and thereafter into said central bore; and a ball retaining sleeve, said ball retaining sleeve being moveable axially in said bore of said ball launcher relative to said ball launch cavity between a closed position and an open position, said ball retaining sleeve in said closed position configured to least partially block said opening of said ball launch cavity to prevent launching of said ball into said central bore, said ball retaining sleeve in said open position configured to allow said ball to travel from said ball launch cavity into said bore of said ball launcher and into said central bore.

22. The downhole tool of claim 21 further including an actuator sleeve axially moveable at least partially within said bore of said ball launcher and configured to selectively push said ball retaining sleeve from said closed to said open position; and a rod extending into said bore of said ball launcher from said upper end thereof, said rod being configured to move said actuator sleeve axially in said bore of said ball launcher.

23. The downhole tool of claim 22 further including at least one collet disposed upon said rod and selectively engageable with said actuator sleeve, said at least one collet configured to engage said actuator sleeve upon up-hole movement of said rod in said bore of said ball launcher.

24. The downhole tool of claim 19 further including upper and lower flapper valve assemblies disposed within said central bore, said upper flapper valve assembly being disposed up-hole of said lower flapper valve assembly in said central bore;

at least a first releasable connector retaining said upper flapper valve assembly in a fixed position relative to said central bore, and at least a second releasable connector retaining said lower flapper valve assembly in a fixed position relative to said central bore;

each of said upper and lower flapper valve assemblies including a flapper valve member, each said flapper valve member being pivotably movable across said central bore between an open and a closed position, each said flapper valve member in said open position being configured to not block the flow of fluid in said central bore and, in said closed position, configured to block the flow of fluid in said central bore from above said flapper valve member;

at least a first primary biasing member associated with said lower flapper valve assembly and configured to bias said flapper valve member thereof into said closed position when the downhole tool is initially deployed in the well bore and moved to a desired stationary location therein;

said second releasable connector being configured to release said lower flapper valve assembly from said fixed position upon sufficient fluid pressurization of said central bore above said lower flapper valve assembly, said flapper valve member of said lower flapper valve assembly being configured not to block the flow of fluid in said central bore after said lower flapper valve assembly is released from said fixed position;

a locking sleeve disposed within said central bore proximate to said upper flapper valve assembly, said locking sleeve being releasably engaged with said flapper valve member of said upper flapper valve assembly and configured to hold said flapper valve member of said upper flapper valve assembly in said open position when the downhole tool is deployed into the well bore, said locking sleeve being selectively actuated to disengage from said flapper valve member of said upper flapper valve assembly; and at least a second primary biasing member associated with said upper flapper valve assembly and configured to bias said flapper valve member thereof into said closed position upon disengagement said flapper valve member of said upper flapper valve assembly from said locking sleeve.

25. The downhole tool of claim 24 further including a control sleeve extending into said central bore from said upper end of said mandrel, said control sleeve being configured to engage and actuate said locking sleeve.

26. The downhole tool of claim 24 further including a first secondary biasing member acting on said flapper valve member of said lower flapper valve assembly in the opposite direction as said first primary biasing member, said first secondary biasing member having weaker biasing forces than said first primary biasing member and configured to bias said flapper valve member of said lower flapper valve assembly into said open position after said lower flapper valve assembly is released from said fixed position.

27. The downhole tool of claim 26 wherein said first releasable connector is configured to release said upper flapper valve assembly from said fixed position upon sufficient fluid pressurization of said central bore above said upper flapper valve assembly after said flapper valve member thereof is moved into said closed position, further including a second secondary biasing member acting on said flapper valve member of said upper flapper valve assembly in the opposite direction as said second primary biasing member, said second secondary biasing member having weaker biasing forces than said second primary biasing member and configured to bias said flapper valve member of said upper flapper valve assembly into said open position after said upper flapper valve assembly is released from said fixed position.

28. A method of remotely actuating the drag blocks of a downhole tool in the well bore of an oil and gas well, the downhole tool having a central bore, each drag block being mounted in a respective drag block housing and being spring-biased radially outwardly by at least one biasing member, the method comprising:

at least one retainer connecting each drag block to at least one selectively axially movable retention sleeve;

the at least one retainer holding the drag block associated therewith in a retracted position, the drag block in the retracted position being disposed proximate the drag block housing associated therewith and spaced away from the well bore wall when the downhole tool is disposed therein;

deploying the downhole tool to a desired location in the well bore;

moving the at least one retention sleeve axially relative to the drag blocks and retainers;

the at least one retention sleeve disengaging each retainer from at least one among the drag block associated therewith and the at least one retention sleeve;

allowing the at least one biasing member associated with each drag block to expand radially outwardly and bias the drag block into an extended position in contact with the well bore wall;

temporarily blocking fluid flow in the central bore of the downhole tool downhole of the drag blocks;

pressurizing the central bore;

allowing fluid in the central bore to enter and pressurize a first pressure chamber that fluidly communicates with the central bore; and fluid pressure in the pressure chamber causing the at least one retention sleeve to move axially relative to the drag blocks, causing each retainer to disengage from at least one among its associated drag block and the at least one retention sleeve.

29. The method of claim 28 further including providing a first flapper valve member in the central bore of the tool downhole of the drag blocks; and the first flapper valve member moving into a seated position and blocking fluid flow in the central bore above the first flapper valve member to allow the central bore and first pressure chamber to be pressurized.

30. A method of remotely actuating the drag blocks of a downhole tool in the well bore of an oil and gas well, the downhole tool having a central bore, each drag block being mounted in a respective drag block housing and being spring-biased radially outwardly by at least one biasing member, the method comprising:

at least one retainer connecting each drag block to at least one selectively axially movable retention sleeve;

the at least one retainer holding it's associated the drag block associated therewith in a retracted position, the drag block in the retracted position being disposed proximate to its associated the drag block housing associated therewith and spaced away from the well bore wall when the downhole tool is disposed therein;

deploying the downhole tool to a desired location in the well bore;

moving the at least one retention sleeve axially relative to the drag blocks and retainers;

the at least one retention sleeve disengaging each retainer from at least one among its associated the drag block associated therewith and the at least one retention sleeve; allowing the at least one biasing member associated with each drag block to expand radially outwardly and bias the drag block into an extended position in contact with the well bore wall;

providing at least one selectively axially movable retraction sleeve on the downhole tool over the drag blocks, the at least one retraction sleeve having a plurality of windows formed therein;

the at least one retraction sleeve allowing the drag blocks in their extended position to extend through the windows;

when it is desired to disengage the drag blocks from the well bore wall, selectively moving the at least one retraction sleeve axially relative to the drag blocks;

the at least one retraction sleeve urging the drag blocks radially inwardly into a retracted position, compressing the biasing members associated therewith; and the at least one retraction sleeve holding the drag blocks in the retracted position.

31. The method of claim 30 further including temporarily blocking fluid flow in the central bore of the downhole tool downhole of the drag blocks;

pressurizing the central bore;

allowing fluid in the central bore to enter and pressurize a second pressure chamber that fluidly communicates with the central bore; and fluid pressure in the pressure chamber causing the at least one retraction sleeve to move axially relative to the drag blocks and bias the drag blocks into a retracted position.

32. The method of claim 31 further including providing a second flapper valve member in the central bore of the tool downhole of the drag blocks; and the second flapper valve moving into a seated position and blocking fluid flow in the central bore above the second flapper valve member to allow the central bore and second pressure chamber to be pressurized.

33. The method of claim 31 further including providing a ball seat in the central bore of the tool downhole of the drag blocks;

dropping a ball into the central bore from above the downhole tool; and the ball seating on the ball seat and blocking fluid flow in the central bore above the ball to allow the central bore and second pressure chamber to be pressurized.

34. The method of claim 30 further including temporarily blocking fluid flow in the central bore of the downhole tool downhole of the drag blocks;

pressurizing the central bore;

allowing fluid in the central bore to enter and pressurize a second pressure chamber that fluidly communicates with the central bore; and fluid pressure in the pressure chamber causing the at least one retraction sleeve to move axially relative to the drag blocks and bias the drag blocks into a retracted position.

35. The method of claim 34 further including providing a flapper valve member in the central bore of the tool downhole of the drag blocks; and the flapper valve moving into a seated position and blocking fluid flow in the central bore above the flapper valve member to allow the central bore and second pressure chamber to be pressurized.

36. The method of claim 34 further including providing a ball seat in the central bore of the tool downhole of the drag blocks;

dropping a ball into the central bore from above the downhole tool; and the ball seating on the ball seat and blocking fluid flow in the central bore above the ball to allow the central bore and second pressure chamber to be pressurized.

37. A method of remotely actuating the drag blocks of a downhole tool in the well bore of an oil and gas well, the downhole tool having a central bore, each drag block being mounted in a respective drag block housing and being spring-biased radially outwardly by at least one biasing member, the method comprising:

providing at least one selectively axially movable retraction sleeve on the downhole tool over the drag blocks, the at least one retraction sleeve having a plurality of windows formed therein;

the at least one retraction sleeve allowing the drag blocks to extend through the windows and engage the well bore wall;

when it is desired to disengage the drag blocks from the well bore wall, selectively moving the at least one retraction sleeve axially relative to the drag blocks;

the at least one retraction sleeve urging the drag blocks radially inwardly into a retracted position, compressing the biasing members associated therewith; and the at least one retraction sleeve holding the drag blocks in the retracted position.

* * * * *